United States Patent [19]

Iannucci et al.

[11] 4,034,642

[45] July 12, 1977

[54] BRAIDING MACHINE

[75] Inventors: Vincent Alfonso Iannucci, West Lawn; Rudolf Herbert Haehnel, Reading; Ronald Scheck Schartel, North Whitfield, all of Pa.

[73] Assignee: Rockwell International Corporation, Pittsburgh, Pa.

[21] Appl. No.: 727,092

[22] Filed: Sept. 27, 1976

[51] Int. Cl.[2] ..... D04C 3/06; D04C 3/42

[52] U.S. Cl. ..... 87/48

[58] Field of Search ..... 87/44–48, 87/61

[56] References Cited

U.S. PATENT DOCUMENTS

| | | | |
|---|---|---|---|
| 958,512 | 5/1910 | Le Blanc | 87/48 |
| 1,059,523 | 4/1913 | Brondel | 87/47 |
| 1,888,477 | 11/1932 | Standish | 87/47 |
| 1,955,206 | 4/1934 | Standish | 87/47 |
| 1,981,377 | 11/1934 | Standish | 87/47 |
| 3,892,161 | 7/1975 | Sokol | 87/48 X |

*Primary Examiner*—John Petrakes

[57] ABSTRACT

A braiding machine for braiding a plurality of strands includes a tubular member which has a first rotatable table, a stationary sun gear and a second rotatable table mounted thereon. The first table is rotated in a first direction and includes a circular array of rotatable shafts mounted thereon. Each of the shafts is parallel with the tubular member and has a planetary gear mounted on an intermediate portion thereof which is aligned with and engages the sun gear to cause rotation of the shaft as the first table rotates. A drive gear is fixedly mounted on a first end of each shaft in engagement with an encircled gear on the second table to cause the second table to rotate about the tubular member in an opposite direction from the first direction. The first table includes a circular array of outer strand supply bobbins corresponding with the array of shafts. A circular track is mounted on the first table between the circular array of outer strand supply bobbins and the area of braiding and is segmented by there being included a slot at each of the outer strand supply bobbins. Each slot enables an aligned strand guide arm which is pivotally mounted on the first table and connected by a crank and linkage arrangement to a second end of its corresponding shaft to be oscillated thereby to direct the outer strand inwardly and outwardly of the circular track. Each of a plurality of inner strand supply bobbins is mounted on the circular track for movement therealong in the opposite direction by an associated pair of alternating drive dogs mounted on the second table and adapted to prevent contact with the outer strands when they are inwardly of the circular track and corresponding inner strand supply bobbin.

12 Claims, 5 Drawing Figures

83
90
120
81
132
128
134
136
130
136
136
44
122
126
126
124
Z

BRAIDING MACHINE

BACKGROUND OF THE INVENTION

1. Field of the Invention

This invention relates to a braiding machine and, more specifically, to such a machine which includes a circular array of outer strand supply bobbins which move in one direction, a circular array of inner strand supply bobbins which move in the opposite direction and an oscillating device for directing the outer strand inwardly and outwardly of the inner strand supply bobbins to form a completed braided product or to provide a braided jacket for a core member being drawn through the machine.

2. Description of the Prior Art

There have heretofore been provided a number of braiding machines which are employed to braid a plurality of strands into a combined work product. Some of these machines include mechanisms for directing a plurality of strand supply bobbins inwardly and outwardly of each other through elaborate gearing and camming means. The gearing and camming means are quite complicated to manufacture and maintain and tend to limit the speed at which braiding can be accomplished. There are, however, other commonly used types of braiders which include a plurality of inner bobbins and a plurality of outer bobbins which are caused to rotate in opposite directions while the strand from the outer bobbin is directed inwardly and outwardly of the array of inner bobbins to produce the braiding. It is these latter types of machines to which the present invention is directed.

To direct the outer strands inwardly and outwarly of the inner strand bobbin a number of machines, such as those disclosed in U.S. Pat. Nos. 647,410, 814,711 and 1,660,049 and British Pat. Nos. 13,560 and 109,180, have used an oscillating strand guide of one form or another. U.S. Pat. No. 647,410 and British Pat. No. 13,560 employ a cam track and U.S. Pat. No. 814,711 employs a rotating cam to produce the desired movement of the guide. Although a camming means can be effectively utilized to control the guiding path of the strand inwardly and outwardly of the bobbins, they tend to be more susceptible to wear and are often more complicated to lubricate. British Pat. No. 109,108, on the other hand, employs a simple crank linkage on a large gear member to produce a simple sinusoidal guiding path. The larger gear mounting and driving structure appears to significantly add to the overall weight and size of the machine and to generally prevent horizontal orientation of the machine's axis. The oscillating guide means of U.S. Pat. No. 1,660,049 is driven by an air actuated means complicating the machine's support requirements.

Accordingly, another form of braiding machine was alernatively employed in an effort to eliminate some of these problems and was of the type generally disclosed in U.S. Pat. Nos. 958,512; 1,059,523; 1,888,477; 1,955,206 and 1,981,377. Like the machines of the patents cited hereinabove, each of these machines must include structure and means for mounting an array of outer strand supply bobbins and an array of inner strand supply bobbins and for causing relative opposite circular movement thereof. The means for driving each of the inner strand supply bobbins must be of a form which will allow the outer strand to be directed inwardly and outwardly of the array of inner strand supply bobbins in a manner which will produce braiding. In this latter group of machines a pair of rotating dogs are employed for this driving means and are adapted to ensure that at least one of the dogs will be engaged with its respective inner strand supply bobbin to provide driving force thereto as the other dog is sufficiently displaced therefrom to allow passage of the outer strand inwardly of the bobbin. However, to ensure that the outer strand will be directed inwardly and outwardly of the inner strand supply bobbins, these prior art devices include a camming surface fixedly mounted relative to each inner bobbin for predetermined deflection of the outer strand inwardly and outwardly thereof. The utilization of a camming means of this type has generally limited the speed at which these braiding machines can be operated. The resulting transverse frictional force which the camming surfaces produce on the strand as the speed of the braiding machine increases tends to wear out the strand and cause it to break or produce a drag on the strand which will cause it to become fouled in other regions of the machine. Nevertheless, although there is no detailed disclosure of the strand guiding system, it appears that some machines, such as the one disclosed in U.S. Pat. No. 3,756,117 are still being introduced which rely on this limited method of strand guiding.

It can generally be said of the prior art machines described hereinabove that they each rely upon one or more features which tend to limit the speed at which the machine can be operated, increase the overall size and weight of the machine, decrease the number of strands that can be braided or limit the size of strand supply bobbins which can be utilized.

SUMMARY OF THE INVENTION

It is, therefore, an object of the present invention to provide a high speed braiding machine which will employ a large number of strand supply bobbins.

It is another object to provide a braiding machine of the type described which includes a means for guiding the outer strands inwardly and outwardly of the inner strand supply bobbins which is reliable, is simple to provide and will effectively guide the strands at higher braiding speeds without damage thereto.

It is still another object of the invention to provide a braiding machine of the type described which incorporates an effective means for opposite rotation of the inner strand supply bobbins and the outer strand supply bobbins while minimizing the overall size of the machine.

These and other objects of the invention are provided in a preferred embodiment thereof which includes a braiding machine for braiding a plurality of strands which machine includes a tubular member having a first rotatable table, a stationary sun gear and a second rotatable table mounted thereon. The first table is rotated in a first direction and includes a circular array of rotatable shafts mounted thereon. Each of the shafts is parallel with the tubular member and has a planetary gear mounted thereon which is aligned with and engages the sun gear to cause rotation of the shafts as the first table rotates. A drive gear is fixedly mounted on at least one of the shafts in engagement with an encircling gear on the second table to cause the second table to rotate about the tubular member in an opposite direction from the first direction. The first table includes a circular array of outer strand supply bobbins corresponding with the array of shafts. A circular track is mounted on the first table between the array of outer strand supply bobbins and the area of braiding and is segmented by there being included a radial slot therethrough at each of the outer strand supply bobbins. Each slot enables an aligned strand guide arm which is pivotally mounted on the first table and connected by linkage and crank means to its corresponding shaft to be oscillated thereby to direct the outer strand inwardly and outwardly of the circular track. Each of a plurality of inner strand supply bobbins is mounted on the circular track for movement therealong in the opposite direction by an associated drive means mounted on the second table and adapted to prevent contact with the outer strands when they are inwardy of the circular track and the corresponding inner strand supply bobbins.

DETAILED DESCRIPTION OF THE PREFERRED EMBODIMENT

Figure 1:
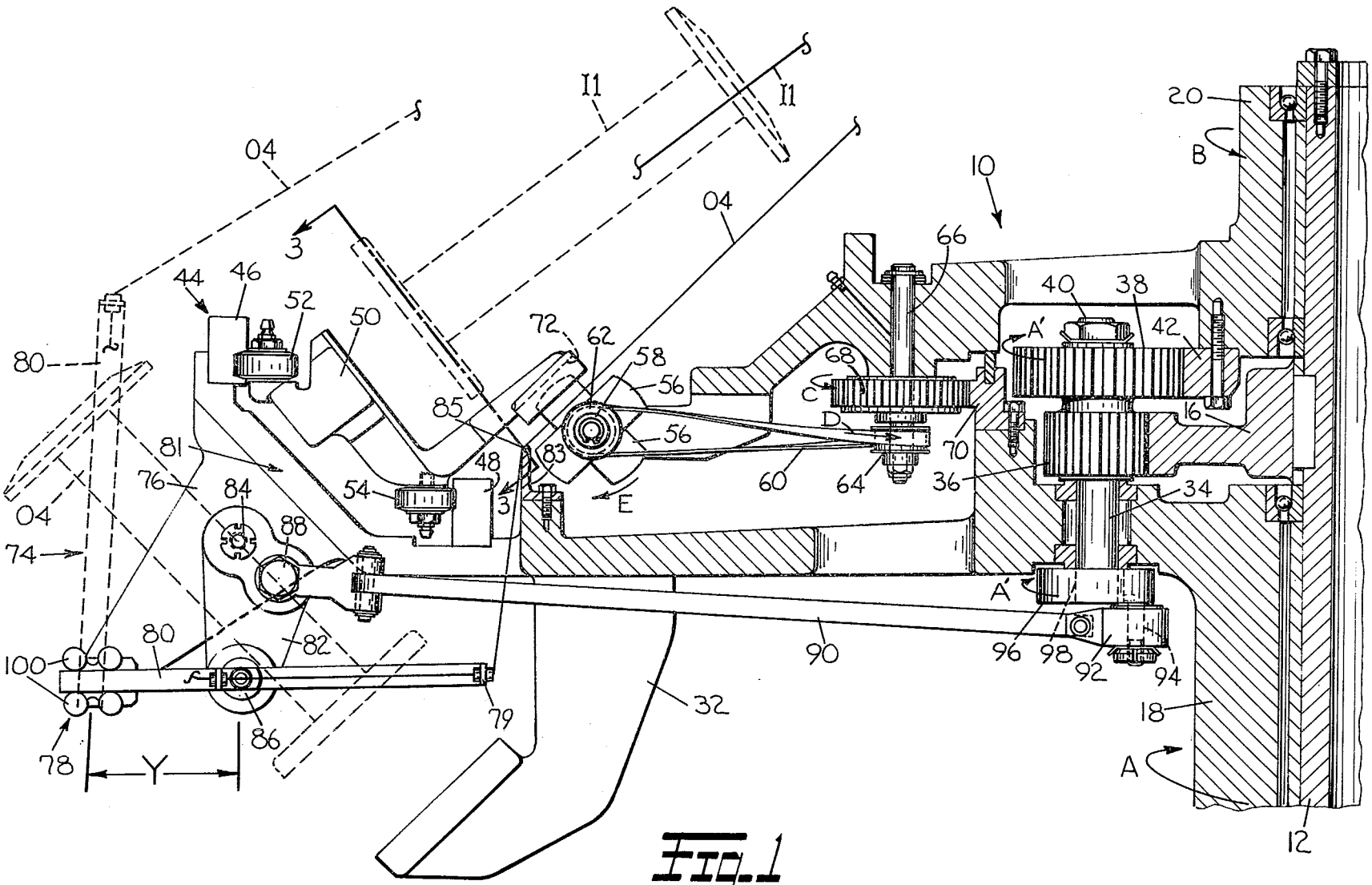
FIG. 1 is a fragmentary, sectional side view of a braiding machine including various features of the invention.

As seen in FIG. 1, a braiding machine 10 includes a tubular member 12 through which a hose or similar work product 14 (FIG. 2) is drawn by associated machinery at a predetermined rate during braiding. In the preferred braiding machine 10 the tubular member 12 is stationary and includes a stationary sun gear 16 mounted at an intermediate portion thereof. A first rotatable table 18 is mounted to one side of the sun gear 16 and a second rotatable table 20 is mounted to the other side of the sun gear 16 on the tubular member 12.

Figure 2:
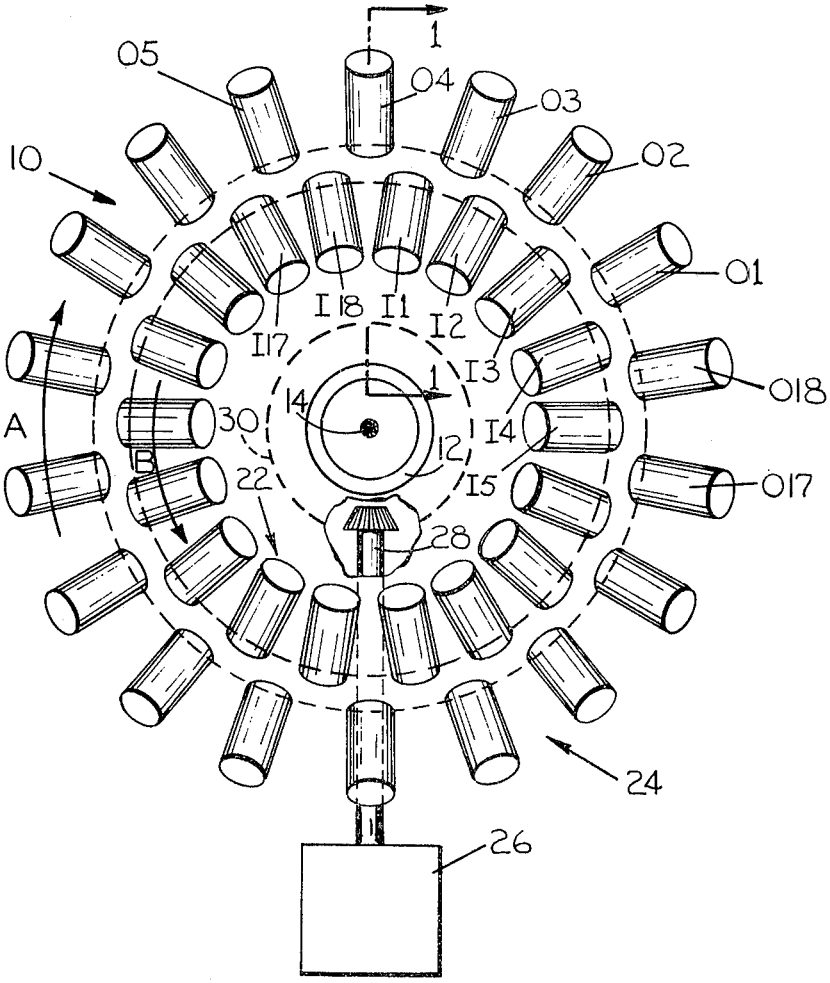
FIG. 2 is a schematic view of the braiding machine shown in FIG. 1 showing the relative positions of the various strand bobbins mounted thereon.

As best seen schematically in FIG. 2, the preferred braiding machine 10 includes a circular array 22 of inner strand supply bobbins $I_1 - I_{18}$ and a concentric circular array 24 of outer strand supply bobbins $0_2 - 0_{18}$. The relative dimensions shown in FIG. 2 are generally those which would be found in the preferred embodiment of the invention and provide some indication of the relative close spacing of the bobbins which the present invention affords. The strand supply bobbins $I_1 - I_{18}$ and $0_1 - 0_{18}$ and associated strand control mechanisms relating thereto are generally of the type disclosed in U.S. patent application Ser. No. 679,763, "Strand Carrier For A Strand Fabricating Machine," filed on Apr. 23, 1976 by R. H. Haehnel and B. L. Graeff. This type of mounted and strand controlled mechanism allows the strand to be drawn from its respective bobbin under tension and restricts rotation of the bobbin accordingly. A motor 26 and associated drive shaft 28 are shown in FIG. 2 for mating alignment with a gear 30 on the first rotatable table 18 to impart rotation thereto. The general configuration is shown simply by way of example since there are many methods well known in the art which may be employed for basic powered rotation of the table 18. As will be explained hereinbelow, the motor 26 will cause the outer array of bobbins 24 to rotate in a clockwise direction as indicated by the arrow A and will result in the inner array of bobbins 22 being rotated in the counterclockwise direction as indicated by the arrow B.

Although the basic bobbins are designated $I_1$, $I_2$, etc. in FIG. 2, the same designator will be utilized elsewhere to indicate the strand itself which is supplied by that bobbin. The same designation has been used since it is felt that a better understanding of the finished product and the guided paths of the strands which produce the braiding is possible if the bobbins from which they originate are used as a basic reference. Additionally, it will be noted in FIG. 2 that the line 1—1 is included to provide a general understanding of the view in FIG. 1 which includes the inner strand supply bobbin $I_1$ and the outer strand supply bobbin $0_4$ in phantom. Although the preferred braiding machine 10 is generally shown in FIG. 2 to have the tubular member 12 oriented horizontally, there is nothing which prevents it from being oriented vertically as generally shown in FIG. 1

Returning to FIG. 1, it should be understood by one skilled in the art that various elements of the machine which will be described are associated with each of the bobbins in the preferred braiding machine 10. Therefore, although only one element might be shown, a corresponding number of such elements would be found in the machine. The first rotatable table 18 is, as explained above, caused to rotate in a clockwise direction when viewed from above as indicated by the arrow A. For each outer strand supply bobbin $0_1$–$0_{18}$ which is rigidly supported on a support bracket 32 of the first table 18 there is a rotatably mounted shaft 34 extending through the table 18. The shafts 34 are parallel with the tubular members 12 and are dispersed in a concentric circular array thereabout. A planetary gear 36 intermediately disposed on the shaft 34 is aligned with and engages the stationary sun gear 16. Rotation of the first table 18 in the direction A causes the planeatry gear 36 to act upon the stationary sun gear 16 to produce rotation of the shaft 34 in a direction A'. A larger gear 38 is rigidly mounted at an upward end 40 of the shaft 34 and is aligned with and engages a circular drive gear 42 of the second table 20. Although each shaft 34 will tend to move clockwise about the tubular member 12, the rotation imparted to the larger gear 38 will act on the second table 20 to cause it to rotate counterclockwise as indicated by arrow B and as discussed above.

To produce the basic relative movement between the bobbins required for braiding, it is essential for the outer bobbins to move circumferentially relative to the inner bobbins. The outer bobbins are rigidly mounted to the first table 18 by the support structure 32 while the inner bobbins are supported by the first table 18 but are capable of revolving thereon about the tubular member 12 relative to the outer bobbins. Accordingly, the first table 18 includes a circular track element 44 near its outer periphery. The track element 44 includes a pair of tracks 46 and 48 which are adapted to receive an inner strand supply bobbin carrier 50 therebetween. The carrier 50 employs two sets of wheels 52 and 54 which sets (only one of each set of two or more wheels is shown in FIG. 1) are respectively received within the tracks 46 and 48. Accordingly, each inner strand supply bobbin which is secured to its respective inner strand supply bobbin carrier is mounted on the table 18 but is free to move relative thereto along the track element 44.

It is desirable for the movement of the second table 20 to be imparted to each carrier 50 and its associated inner strand supply bobbin to produce the relative movement between the bobbins which braiding requires. For this purpose a pair of rotating drive dogs 56 are provided for each carrier 50. The pair of drive dogs 56 are mounted for rotation on a shaft 58 on the second table 20 and are longitudinally spaced one from the other on the shaft 58. The pair of drive dogs 56 are caused to rotate during operation of the braiding machine 10 for a purpose which will be explained hereinbelow. Specifically, a drive belt 60 is adapted to mate with and act on a pulley 62 fixedly mounted at one end of the shaft 58. The belt 60 is driven by a pulley 64 of a shaft 66 which is also mounted for rotation on the second table 20. A shaft 66 is provided for each inner strand supply bobbin and is combined with other such shafts 66 to be arranged in a circular array on the table 20 around the tubular member 12. Each shaft 66 includes a gear 68 mounted thereon which is aligned with a circular drive gear 70 of the first table 18. Relative rotation between the tables 18 and 20 causes the shaft 66 to be rotated in a direction indicated by the arrow C which, in turn, causes the belt 60 to be moved in a direction indicated by the arrow D. As a result, during operation of the braiding machine 10 the pair of dogs 56 will rotate as shown by the arrow E.

To complete the contact between the bobbin carrier 50 and the second table 20, a pair of grooves 72 are formed in the bobbin carrier 50 and are separated one from the other so that each will be aligned with a respective one of the pair of dogs 56. The dogs 56 are angularly displaced one from the other so that during rotation thereof at least one of the dogs 56 will be received by and in contact with its respective groove 72. Accordingly, rotation of the second table 20 in the direction indicated by the arrow B will be imparted to each carrier 50 and its associated inner strand supply bobbin by the corresponding pair of drive dogs 56 mounted on the second table 20. However, the drive imparted thereto is of a general type which is disclosed in several of the prior art patents cited above and allows the strand from the outer strand supply bobbin to freely pass inwardly of an inner strand supply bobbin as is required in one form or another in any braiding operation.

Accordingly, the basic braiding configuration of the present invention requires the strands from the inner strand supply bobbins to be generally drawn directly therefrom toward the area of braiding on the work product 14, as shown by strand $I_1$ in FIG. 1. However, the strands originating from the outer strand supply bobbins must be disposed inwardly and outwardly of the inner strand supply bobbins in one pattern or another during relative movement therebetween to produce a type of braiding. To accomplish this basic movement of the outer strands inwardly and outwardly of the array 22 of inner strand supply bobbins, a strand guide device 74 of the preferred machine 10 is provided. The strand guide device 74 includes a support bracket 76 extending radially from the first table 18 and has a pivoting device 78 at its extended end for receipt therein of a strand guide arm 80. The strand guide arm 80 is thereby capable of being oscillated from an inward position as shown in FIG. 1 to an outward position as indicated in phantom in FIG. 1. One or more guide eyes 79 are mounted on the strand guide arm 80 to guide the strand (in FIG 1, strand $O_4$) from the outer strand supply bobbin to the area of braiding on the work product 14.

A radial slot 81 in the first table 18 is provided for each outer strand supply bobbin to allow movement of the arm 80, and the strand extending therefrom, inwardly and outwardly of the inner strand supply bobbins as needed for the particular type of braiding desired. The slot 81 must extend through the track element 44 and each track 46, 48 thereof causing the circular track element 44 to be segmented into separate sections which are circumferentially aligned one with the other. Each carrier 50 is capable of freely and smoothly passing from one section of the track element 44 to the next since at least one of each opposed sets of wheels 52 and 54 remains engaged with the tracks 46 and 48 at all times. Inward movement of the strand is limited by a strand limiting guide 83 as seen at 85 for strand $O_4$. The strand limiting guide 83 is secured to the first table 18 at the inward end of the slot 81 and is located adjacent the dogs 56 and the grooves 72 of carrier 50 to ensure alignment of the strand therebetween as the inner strand supply bobbin moves outwardly thereby. The strand limiting guide 83 does not "cam" the strand in the manner found in some of the prior art devices cited above. Since there is no relative circular movement between the strand and its associated strand limiting guide 83 (both are moving circumferentially with the first table 18), no transverse frictional forces are applied to the strand so that no wear or drag problems will be encountered which might otherwise reduce the braiding speed of the machine 10.

To accomplish the desired oscillation of the arm 80 a lever device 82 is pivotally mounted at 84 on the support bracket 76. One location on the lever 82 includes a pivotal fitting 86 which is joined to the arm 80 at an intermediate location thereon. A second location on the lever 82 includes a pivotal fitting 88 which is coupled to a linkage 90 which extends inwardly toward the center of the table 18 and generally toward the shaft 34. The inward end 92 of the linkage 90 is received on a crank pin 94 of a crank 96 which is rigidly fixed to the lower end 98 of the shaft 34 for rotation therewith. The linkage 90 includes appropriate fittings at both ends thereof for unrestricted transfer of the rotational movement of the crank 96 into arcuate movement of the lever 82. Consequently, as the shaft 34 rotates, the crank 96 through its pin 94 moves the linkage 90 longitudinally in response thereto. The resulting inward and outward movement at the fitting 88 causes the lever 82 to swing about its pivotal fitting 84 through a limited sector of movement for each rotation of the crank 96. The resulting predetermined arcuate path of the fitting 86 on the lever 82 causes, for each revolution of the crank 96, the arm 80 to be pivoted about the pivoting device 78 from the position shown in FIG. 1 to the position shown in phantom and back to its original position. The pivoting device 78 includes opposed pairs of rollers 100 which retain the arm 80 therebetween but allow longitudinal movement of the arm 80 therethrough. Accordingly, as the fitting 86 of lever 82 begins its arcuate path the arm 80 is forced to move longitudinally relative to the rollers 100 to decrease the distance between the fitting 86 and the pivoting device 78. After the arm 80 has passed through an intermediate position (not shown) the distance therebetween will begin to increase again as the arm 80 moves longitudinally in the other direction.

As thus provided in the preferred embodiment, the planetary gear 36 for the shaft 34 and the crank 96 are dimensioned for a predetermined rate of revolutions corresponding to the relative movement between the tables 18 and 20. As a result of this dimensioning, the guide arm 80 will be generally inwardly of the track element 44 as two inner strand supply bobbins are relatively moved thereby and is located generally outwardly of the track element 44 as the next two inner strand supply bobbins move thereby.

Figure 3:
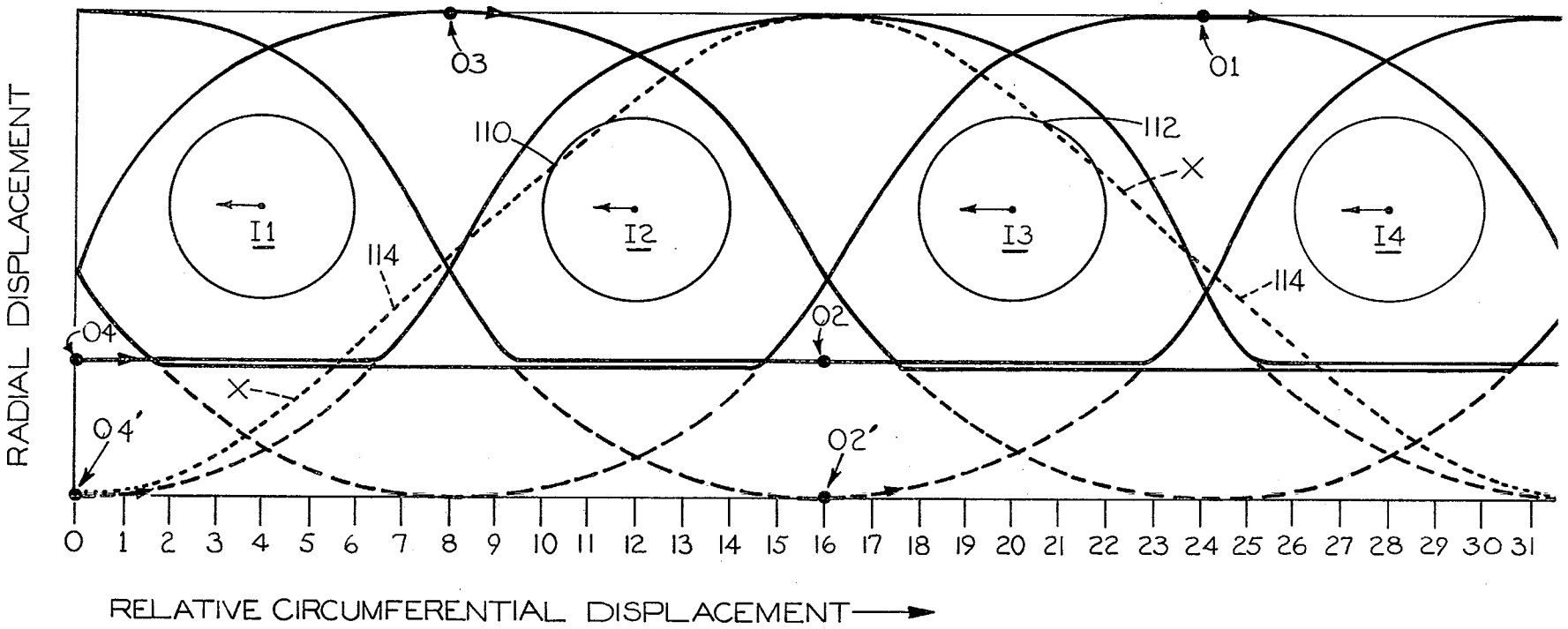
FIG. 3 is a schematic view of the guide paths of the strands of the braiding machine shown in FIG. 1 which produces the braiding.

For a better understanding of the actual paths of the strands being supplied by the outer strand supply bobbins relative to the inner strand supply bobbins, a schematic representation is shown in FIG. 3. The view in FIG. 3 is that which would be seen from a fixed location on the second table 20. From this location one would tend to see only the ends of bobbins $I_1$, $I_2$, $I_3$ and $I_4$ and they would be stationary. The horizontal distance between the inner strand supply bobbins is consistent with that shown in FIG. 2 when it is realized that the view of FIG. 3 is of a curved surface which has been flattened to show the paths of the outer strands as they intersect a plane generally defined by line 3—3 of FIG. 1. The arrows shown in FIG. 3 at the center of each of these bobbins serve only as a reminder of the relative rotation of the inner strand supply bobbins with respect to the outer strand supply bobbins and do not represent any actual movement as shown in FIG. 3.

The vertical line at the left of FIG. 3 is labeled "Radial Displacement" and has upper and lower limits defined by the extremes of the paths of the strands from the outer strand supply bobbins as they intersect the plane 3—3 which paths are created by movement of the associated guide arm 80 for each outer strand supply bobbin during braiding. The scale provided horizontally at the bottom of FIG. 3 is labeled "Relative Circumferential Displacement" and ranges from 0 to 31, where 32 units would represent one complete revolution of a crank 96. Accordingly, at the left hand side the 0 position is the position shown in FIG. 1 where the pin 94 of the crank 96 for its associated outer strand supply bobbin $0_4$ is in an inward position, closest to the tubular member 12. With the various angular positions of the pin 94 during one rotation being divided into thirty-two equal positions, it can be seen that the pin 94 would be at position "16" when it is farthest from the tubular member 12 and thus causes the guide arm 80 associated with the outer strand supply bobbin $0_4$ to be at the location shown in phantom in FIG. 1. Continuing through a complete rotation of the crank 96 in the direction indicated by the arrow A′ in FIG. 1 would bring the pin 94 back to a position which would be identical with the 0 position, whereupon a new revolution would begin. Therefore, the strand $0_4$ in FIG. 3 is in a position corresponding to that which is shown in FIG. 1.

Following the arrow from strand $0_4$ to the right enables one to see the relative path imparted to the strand as it moves inwardly and outwardly of the inner strand supply bobbins. For an understanding of the general path which would be produced if the strand limiting device 83 were not employed, an unrestricted position of the strand is designated $0_4'$. Similarly, the unrestricted path of the strand $0_4'$ is shown by an associated arrow to indicate the path the strand would assume without the use of the strand limiting guide 83.

Also included in FIG. 3 are the relative locations of the strands $0_3$, $0_2$ and $0_1$ when the strand $0_4$ is at the 0 position. It is possible from an understanding of FIG. 3 to determine the relative positions of the strands from the outer strand supply bobbins if the position of any one strand is known. For example, when $0_4$ is inwardly of bobbins $I_{18}$ (not shown) and $I_1$ and relatively therebetween, strand $0_3$ is outwardly of bobbins $I_1$ and $I_2$ and relatively therebetween. Accordingly, the initial position of the pins 94 of the cranks 96 are preselected to locate the guide arm 80 for each outer strand supply bobbin at the desired position relative to the other bobbins. Therefore, the "Relative Circumferential Displacement" and the scale shown correspond with the position of the crank 96 associated with the outer strand supply bobbin $0_4$. When it is at the "0" position, as shown in FIG. 3, the crank 96 associated with the outer strand supply bobbin $0_3$ would be at a 16 position.

Braiding is therefore accomplished by strand $0_4$ passing inwardly of strand $I_1$ and then outwardly between strands $I_1$ and strands $I_2$. At the same time strand $0_3$ passes outwardly of strand $I_2$ and then inwardly between strands $I_2$ and $I_3$. Also, at the same time, strand $0_2$ would be passing inwardly of strand $I_3$ and then passing outwardly between strand $I_3$ and $I_4$. The result is that each strand from an outer strand supply bobbin passes outwardly of two inner strand supply bobbins and the associated strands therefrom and then moves inwardly to pass inwardly of the next two inner strand supply bobbins and the strands associated therewith.

Figure 4:
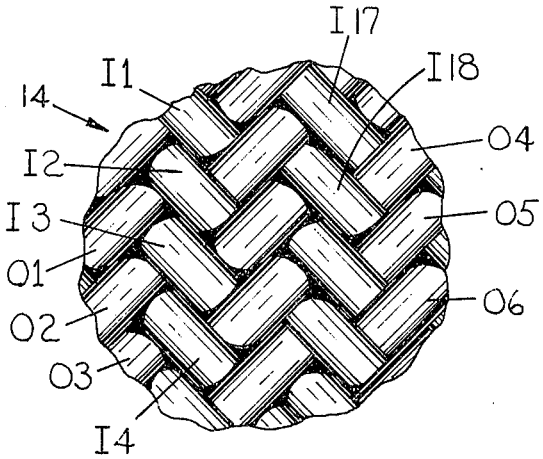
FIG. 4 is a fragmentary view of the surface of a braided product produced by the machine of FIG. 1.

The resulting braid is shown in FIG. 4 as it would appear from the left of FIG. 1 looking back toward the work product 14 which would be located toward the right of FIG. 1. The same designations for the strands are employed in FIG. 4 for a full understanding of the braiding which will be produced by the machine 10 as discussed hereinabove.

As explained thus far, the various elements and configurations described and shown for the preferred braiding machine 10 provide an effective means for providing the preferred braiding pattern. However, there are specific features employed which make the preferred braiding machine 10 particularly attractive and specifically adapted to satisfy the objectives of the invention. The large number of bobbins and the relatively close spacing therebetween as evidenced in FIG. 2 are made possible by the manner in which guide arm 80 is caused to oscillate.

With a more direct coupling of the crank 96 to the arm 80, the path of the strands from the outer strand supply bobbins relative to the inner strand supply bobbins would generally be sinusoidal as shown by the dotted line X for strand $0_4$ on FIG. 3. If a strand were to follow a sinusoidal path X having the same Radial Displacement as provided by the present invention, it would not be able to freely pass outwardly of the bobbins (contact would be made with bobbins $I_2$ and $I_3$ as indicated at 110 and 112 respectively). Although not as clearly demonstrated by FIG. 3, it has additionally been found that interfering contact would also exist when the strands were inwardly of the bobbins, as at 114. A strand following the sinusoidal path X would not be held against the strand limiting guide 83 for enough time to ensure that the carrier 50 and dogs 56 would pass clearly thereby. The interfering contact which would result from a strand on path X becomes even more obvious when one recognizes that the representation of the inner bobbins in FIG. 3 are simplified and do not include the carrier 50 or associated strand control mechanism which extends beyond the edges of the bobbins as shown.

The desired strand path is obtained by varying the rate of movement of the guide arm 80 during oscillation. Clearance between the strand and the bobbins is maintained by more rapid movement of the strand when it is being transferred from an inward to an outward location relative the inner strand supply bobbin and vice versa. The slop of the curved path is greater and thus the rate of change in the Radial Displacement is greater during transfer for the present invention than can be obtained with a sinusoidal path X.

The faster transfer with a longer delay time in the inward and outward locations is accomplished by the type of coupling between the crank 96 and the arm 80. While the fitting 86 on the lever 82 would appear to follow a sinusoidal path relative the inner strand supply bobbins, its action on the arm 80 converts the strand path which the arm 80 produces to that path which has been described above. As the pivotal fitting 86 acts on the arm 80, the moment arm Y (established by the distance between the pivotal fitting 86 and the pivoting device 78), which causes angular displacement of the arm 80, varies during rotation of the crank 96 and is the shortest when transferring the strand between the bobbins. The shorter moment arm during transfer increases the rate of Radial Displacement when it is most needed. Further, as the guide arm 80 is positioned at the inward and outward extremes, as generally shown in FIG. 1, the lever 82 has a decreasing effect on the angular movement of the arm 80 since the movement of the fitting 86 is largely translated to the arm 80 to cause longitudinal movement thereto relative the pivoting device 78, rather than simply angular movement. As a result, the delay time for the arm 80 at the inward and outward locations is relatively longer than it would be if it were oscillating in a manner which would produce a sinusoidal path X.

The significance of this configuration can best be seen when one examines the alternatives required for designing the braiding machine if the desired strand path were not produced. By increasing the effective diameter of the track element 44, the space between adjacent inner strand supply bobbins might be increased sufficiently to allow the strand to pass clearly therebetween. This, however, would significantly increase the size and weight of the braiding machine required to accommodate the same number of bobbins presently employed in the preferred machine 10. The same rate of transfer between the bobbins might be obtained even with a sinusoidal path for the strands (where the path has the same slope as the preferred curved path) by significantly enlarging the Radial Displacement. However, this too would require a larger arm 80, lever 82 and/or crank 96 which would add to the overall weight and size of the machine. Either alternative might adversely affect the speed at which braiding could be reliably accomplished.

It should be pointed out that while the preferred machine 10 is arranged to produce a braiding pattern where each strand passes over two and then under two strands, the same strand guiding concept might be employed on a machine with a more simple pattern. Accordingly, the same general strand paths made possible by the present invention might be employed in an alternative machine configuration with perhaps fewer but larger bobbins as the outer strand is guided inwardly and outwardly of each successive inner bobbin. In any desired braiding configuration, the preferred strand path would tend to decrease the expected size and weight of the machine as compared with what would be required if a normal sinusoidal strand guide path were to be utilized.

Figure 5:
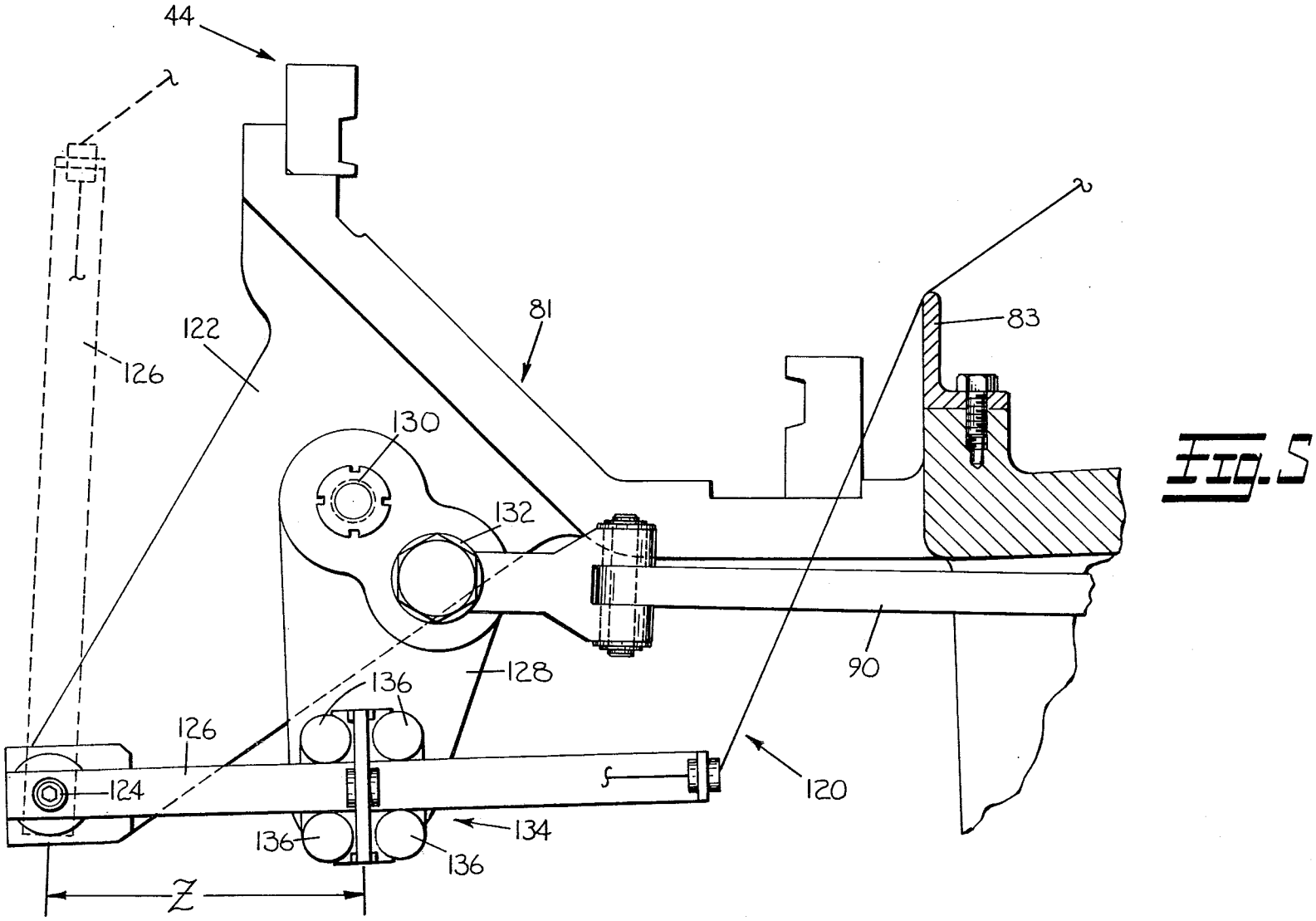
FIG. 5 is a fragmentary view, partially in section, of an alternative feature of the machine shown in FIG. 1.

Although the preferred strand guide device is shown in FIG. 1, an alternative strand guide device 120 is shown by way of example in FIG. 5 as another means for obtaining the strand path as is generally shown in FIG. 3. While the view shown in FIG. 5 does include a number of elements which are identical to those shown in FIG. 1, a track element 44, a radial slot 81, a strand limiting guide 83 and a linkage 90 have been included. A support bracket 122 again extends from the first table and includes a pivot 124 at its extended end for a strand guide arm 126. The arm 126 is shorter than the arm 80 and is joined to the pivot 124 in a manner which prevents any longitudinal movement of the arm 126 relative to the pivot 124.

A lever device 128 is pivotally mounted at 130 to the bracket 122 and is coupled to the linkage 90 at a fitting 132. The end of lever 128, however, is joined to arm 126 by a pivoting element 134. The element 134 includes opposed pairs of rollers 136 which retain the arm 126 therebetween but allow movement of the element 134 longitudinally along the arm 126 as the lever device 128 swings in response to rotation of crank 96. Since the moment arm Z acting on the arm 126 would again vary during each swing of the lever device 128, the desired strand path would again be produced. As the lever device 128 is in an intermediate position with the element 134 nearest the pivot 124 (when the varying distance Z is relatively short), the rate of movement of the guide arm 126 would be the greatest for rapid passage of the outer strand between adjacent inner strand supply bobbins. The present invention, therefore, provides proper guides for the strands from the outer strand supply bobbins without transverse camming of the strands or use of a large cam track arrangement which can complicate lubrication and/or reduce the maximum speed at which braiding could be accomplished.

It should be clear from the disclosure hereinabove that these and other embodiments of the invention could be provided by one skilled in the art without departing from the invention as claimed.

We claim:

1. A braiding machine for braiding a plurality of strands comprising:

a tubular member having a first rotatable table, a stationary sun gear and a second rotatable table mounted thereon;

said first table being rotated in a first direction and including a circular array of rotatable shafts mounted thereon;

each of said rotatable shafts being parallel with said tubular member and having a planetary gear mounted thereon which said planetary gear is aligned with and engages said sun gear to cause rotation of said shaft as said first table rotates;

a drive gear fixedly mounted on at least one of said shafts in engagement with an encircling gear on said second table to cause said second table to rotate about said tubular member in an opposite direction from said direction;

said first table including a circular array of outer strand supply bobbins corresponding with said array of said shafts;

a circular track being mounted on said first table between said circular array of said outer strand supply bobbins and an area of said braiding, said track being segmented by there being a radial slot therethrough at each of said outer strand supply bobbins;

a strand guide arm aligned with each of said slots and pivotally mounted on said first table and connected by linkage and crank means to its corresponding said shaft to be oscillated thereby to direct said outer strand inwardly and outwardly of said circular track; and each of a plurality of inner strand supply bobbins being mounted on said circular track for movement therealong in said opposite direction by an associated drive means mounted on said second table and adapted to prevent contact with said outer strands are inwardly of said circular track and a corresponding said inner strand supply bobbin.

2. A braiding machine as set forth in claim 1, wherein each of said shafts includes a first and extending outwardly of said first table away from said second table and said linkage and crank means includes a crank fixedly mounted to said first end for rotation therewith.

3. A braiding machine as set forth in claim 2, wherein said sun gear is located between said first table and said second table and said planetary gear is disposed on said shaft at a portion thereof which is on an opposite side of said first table from said first end.

4. A braiding machine as set forth in claim 3, wherein said drive gear is disposed outwardly of said planetary gear from said first table on an extended end of said shaft.

5. A braiding machine as set forth in claim 4, wherein each of said shafts includes said extended end and said drive gear mounted thereon.

6. A braiding machine as set forth in claim 2, wherein said linkage and crank means includes a connecting rod extending from said crank and a coupling means to join an extended end of said rod to said strand guide arm, said strand guide arm and said coupling means being mounted relative to each other to include means for increasing the rate of movement of said strand guide arm while guiding said strand between said inner bobbins and for increasing the relative time said strand guide arm maintains said strand inwardly and outwardly of said inner bobbins.

7. A strand guide device for a braiding machine for braiding a plurality of strands which machine is of the type which includes a circular array of outer strand supply bobbins mounted on a rotatable table for movement in a first direction, a circular array of inner strand supply bobbins mounted relative to said outer strand supply bobbins for relative movement in an opposite direction from said direction, and means for producing said movement of said inner strand supply bobbins while allowing said strands from said outer strand supply bobbins to pass inwardly and outwardly of said inner strand supply bobbins to produce said braiding, said strand guide device comprising:

a guide arm adjacent each of said outer strand supply bobbins and pivotally mounted at a pivot point to said table, said guide arm having a guide means on an extended end thereof for passage therethrough of said strand from said outer strand supply bobbins to said braiding;

a crank shaft mounted on said table and including means for rotating a crank thereof and in predetermined response to rotation of said table;

a rod joined by a first end thereof to said crank and extending toward said guide arm for general reciprocating movement of an opposite end of said rod in response to rotation of said crank; and means for coupling said opposite end of said rod to said guide arm to cause said guide arm to oscillate about said pivot point for predetermined guiding of said strands from said outer strand supply bobbins inwardly and outwardly of said inner strand supply bobbins.

8. A strand guide device as set forth in claim 7, wherein said opposite end of said rod tends to follow a natural sinusoidal path relative said inner strand supply bobbins and said means for coupling said opposite end of said rod to said guide arm causes said predetermined guiding of said strand to be along a path having a greater maximum slope than said natural sinusoidal path as said strand is maintained at in inward and outward location relative to said inner strand supply bobbins for a longer time than would occur with said natural sinusoidal path.

9. A strand guide device as set forth in claim 7, wherein said means for coupling includes a lever pivotally mounted to said table at a second point a fixed distance from said pivot point, said lever having a first and a second moment arm, said opposite end of said rod being joined to said lever to act on said first moment arm thereof, and said guide arm being joined to said second moment arm of said lever to cause said guide arm to said general reciprocal movement as said lever acts on said guide arm through a third moment arm thereof which said third moment arm has a predetermined varying length from said pivot point.

10. A strand guide device as set forth in claim 9, wherein said second moment arm of said lever and said third moment arm of said guide arm being generally aligned between said second point and said pivot point causes said third moment arm to be relatively short to thereby increase the rate of transfer of said strand between said inner strand supply bobbins during said guiding inwardly and outwardly of said inner strand supply bobbins.

11. A strand guide device as set forth in claim 9, wherein said pivot point includes means for allowing longitudinal movement of said guide arm relative thereto during said predetermined varying of said length of said third moment arm.

12. A strand guide device as set forth in claim 9, further including means at the coupling of said guide arm to said lever at said second moment arm for allowing longitudinal movement of said second moment arm relative to said guide arm during said predetermined varying of said length of said moment arm.

* * * * *

UNITED STATES PATENT AND TRADEMARK OFFICE

CERTIFICATE OF CORRECTION

PATENT NO. : 4,034,642

DATED : July 12, 1977

INVENTOR(S) : Vincent Alfonso Iannucci, Rudolf Herbert Haehnel and Ronald Scheck Schartel It is certified that error appears in the above-identified patent and that said Letters Patent are hereby corrected as shown below:

Column 3, Line 49, delete "$O_2$" and insert -- $O_1$--.

Claim 8, Line 27, delete "in" and insert "an".

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*